US006003522A

United States Patent [19]

Schach

[11] Patent Number: 6,003,522

[45] Date of Patent: Dec. 21, 1999

[54] BARRETTE

[76] Inventor: Bernadine Schach, 269 Timberlake Dr., Azle, Tex. 76020

[21] Appl. No.: 09/182,060

[22] Filed: Oct. 29, 1998

Related U.S. Application Data

[63] Continuation of application No. 08/932,842, Sep. 18, 1997, Pat. No. 5,894,848.

[51] Int. Cl.[6] ..... A45D 8/28

[52] U.S. Cl. ..... 132/279; D28/42

[58] Field of Search ..... 132/54, 282, 245, 132/246, 249, 251, 256, 259, 260, 264, 223, 273, 275, 276, 278, 279, 280, 281; 24/707.8, 709.2; D28/39, 42, 43, 75; 63/43

[56] References Cited

U.S. PATENT DOCUMENTS

| | | | |
|---|---|---|---|
| D. 375,579 | 11/1996 | Nicholson | D28/42 |
| 1,085,552 | 1/1914 | Dinuccio | 132/279 |
| 1,146,934 | 7/1915 | Gleeson | 132/273 |
| 1,584,527 | 5/1926 | Fulton | 132/246 |
| 2,668,547 | 2/1954 | Wille | 132/273 |
| 3,236,246 | 2/1966 | Culligan | 132/54 |
| 4,103,693 | 8/1978 | Reagan | 132/273 |
| 5,174,312 | 12/1992 | Adams | 132/273 |
| 5,303,723 | 4/1994 | Schach | 132/246 |
| 5,454,385 | 10/1995 | George | 132/273 |
| 5,477,870 | 12/1995 | Menaged | 132/279 |
| 5,497,795 | 3/1996 | Hibbard | 132/275 |

FOREIGN PATENT DOCUMENTS

| | | | |
|---|---|---|---|
| 40381 | 3/1932 | France | 132/256 |
| 15018 | of 1907 | United Kingdom | 132/275 |

*Primary Examiner*—Jeffrey A. Smith
*Assistant Examiner*—Eduardo C. Robert
*Attorney, Agent, or Firm*—John L. Sigalos

[57] ABSTRACT

Hair styling accessories including a puffing member specially adapted for shaping hair into a puffed condition. Also included is a specially shaped barrette which is adapted for cooperative combination with the puffing member to position and retain the puffing member in a desired location as well as to provide for separating and manipulating hair in strands as may be desired for a variety of coiffures. The puffing member includes a main section having generally symmetrically convex front and back surfaces to present a puffed appearance. Essentially centrally positioned within the main section there is disposed a thin sheet of malleable or deformable material (e.g., 0.006 inch thick tin foil such as is used for fins in air conditioners) it adapted for manipulation so that the shape of the main section can be altered within a range suitable for a variety of hair styling applications. The puffing member additionally includes an appending region of lesser width which is fitted with at least two apertures provided to accept one or more fastening members such as one or more fingers from the barrette, a hair pin, or another fastening member.

5 Claims, 2 Drawing Sheets

BARRETTE

This is a continuation of U.S. patent application Ser. No. 08/932,842 filed Sep. 18, 1997 and granted as U.S. Pat. No. 5,894,848 on Apr. 20, 1999.

BACKGROUND OF THE INVENTION

This invention relates to hair styling devices and more particularly to a deformable shape specially adapted for independently puffing a person's hair or for cooperative combination with a specially shaped barrette to provide improved positioning and retention at a desired position.

As set forth in U.S. Pat. No. 5,303,723 granted to the inventor of the present invention Apr. 19, 1994, a generally peanut-shaped hair styling device was proposed. According to that proposal, by the advantageous utilization of a combination of elements, an adjustable device presented a number of features including that of versatility in aiding a hair stylist to style long hair into and retain it in any of several desired shapes without requiring the use of bobby pins, hair pins or the like.

A number of other proposals have been made, illustrative of which are those of U.S. Patents Des 172,953 granted to L. M. Dorfinan Sep. 7, 1954; U.S. Pat. No. 374,931 granted to S. H. Brooks Dec. 20, 1887; U.S. Pat. No. 1,971,152 granted to Michel Barmache Aug. 21, 1934; U.S. Pat. No. 2,021,200 granted to 0. F. Placco on Nov. 19, 1935; U.S. Pat. No. 2,262,478 granted to E. C. Thompson Nov. 11, 1941; U.S. Pat. No. 2,406,376 granted to William Huppert Aug. 27, 1946; U.S. Pat. No. 2,435,275 granted to C. S. Hirsch Feb. 3, 1948; U.S. Pat. No. 2,728,347 granted to M. L. Leste Dec. 27, 1955; U.S. Pat. No. 2,765,798 granted to M. L. Carvell Oct. 9, 1956; U.S. Pat. No. 3,419,020 granted to J. L. Courtney Dec. 31, 1968; U.S. Pat. No. 3,693,637 granted to Abraham Sidelman Sep. 26, 1972; U.S. Pat. No. 3,980,092 granted to Tino Garufi Sep. 14, 1976; U.S. Pat. No. 4,150,678 granted to Georgia M. Photopulos Apr. 24, 1979; U.S. Pat. No. 4,648,414 granted to Steve A. Fox et al. Mar. 10, 1987; U.S. Pat. No. 5,284,167 granted to Gayle R. Gill Feb. 8, 1994; and U.S. Pat. No. 5,477,870 granted to Neal M. Menaged Dec. 26, 1995. While the proposals of the prior art appear to offer attractive features, there has continued to be a need for yet an additionally improved styling aid to facilitate shaping and retaining the hair in overlying patterns.

BRIEF SUMMARY OF THE INVENTION

The improved hair styling accessories according to the invention hereof include an improved barrette and a cooperating puffing member hereinafter called a "poof". The poof comprises an exterior sheath of resilient material having an exterior surface adapted for clinging to the hair on one's head. The poof generally includes two sections: a first generally puffy (convex) section, or region, for providing the desired hair puffing, and a second appended section, or region, having at least one pair of aligned and spaced apertures adapted for receiving a fastener such as, preferably, an extending prong of the cooperating barrette, although in the absence of the barrette, other fasteners such as one or more hair pins may be extended through the apertures. In order to provide a shaping characteristic to the poof, there is advantageously provided therewithin a thin sheet of tin or aluminum foil preferably about 0.0006 inches thick such as fin metal employed in some air conditioner condensers. Thus, the poof may be manually bent and re-bent by the user into desired shapes which the poof will normally retain when in place within one's hair.

The barrette, which is adapted for cooperative combination with the aforementioned poof, comprises an elongated base member having a first longitudinal axis defining a center line of an elongated dimension of the elongated base member. The base member preferably has a slightly curved but otherwise generally planar upper surface and a lower correspondingly slightly curved but otherwise generally planar surface, a first end and an opposite end at opposite extremities of the first longitudinal axis of the base member. Mounted to the upper surface there is a first hinge adjacent the first end and offset to a first side of the longitudinal axis and a first elongated clasping member pivotably attached to the base member through the first hinge thereby connecting the first elongated clasping member to the base member to position the elongated central axis of the first elongated clasping member parallel to and offset from the first axis, a first disengageable locking member mounted on the upper surface at the opposite end for disengageabily locking the free end of the first elongated clasping member when the first elongated clasping member is pivoted to bring the free end of the first elongated clasping member into engagement with the first locking member. Also disposed on the upper surface of the base member is a second hinge adjacent the opposite end from the first hinge and offset from the base longitudinal axis to the opposite side of the base longitudinal axis from the elongated central axis of the first elongated clasping member, a second elongated clasping member pivotably attached to the base member through the second hinge thereby connecting the second elongated clasping member to the base member to position the elongated central axis of the second elongated clasping member parallel to and offset from that of the fist elongated clasping member. Also included is a second disengageable locking member for disengageablly locking the free end of the second elongated clasping member when the second elongated clasping member is pivoted to bring its free end into engagement with the second locking member; and a third elongated clasping assembly mounted on the lower slightly curved but generally planar surface of the base member.

OBJECTS AND FEATURES OF THE INVENTION

It is one general object of the invention to improve hair styling accessories.

It is another object of the invention to facilitate manufacture of improved hair styling accessories.

It is still another object of the invention to simplify certain types of hair styling.

It is yet another object of the invention to simplify individual shaping in a hair styling accessory.

It is yet another object of the invention to provide optional inclusion of an auxiliary barrette for cooperative combination with an improved shapeable hair styling accessory.

Accordingly, in accordance with one feature of the invention, a first section comprising the major part of a specially shaped hair styling accessory is made to have front and back sides that are slightly curved so as to be generally symmetrically convex thereby creating surfaces that are partially puffed outwardly from the center thereof.

In accordance with another feature of the invention, a second section of the accessory is of reduced thickness, thereby facilitating its use in fastening the accessory to a person's hair.

In accordance with yet another feature of the invention, aligned apertures are provided within the aforementioned second section thereby advantageously providing for ease in fastening the accessory in place within the wearer's hair.

In accordance with yet another feature of the invention, a generally planar thin sheet of deformable material is sandwiched within the center of the first section of the accessory to provide desired adjustability of the first section within a wide range of shapes so that it can be customized to provide a wide range of hair styling.

In accordance with one additional feature of the invention, an improved barrette is provided for cooperative combination with the above accessory, thereby facilitating the positioning and retention of the accessory in the desired location and further extending the range of its effective use.

These and other objects and features of the invention will be apparent from the following description, by way of example of preferred embodiments, with reference to the drawing.

DESCRIPTION OF A PREFERRED EMBODIMENT

Figure 1:
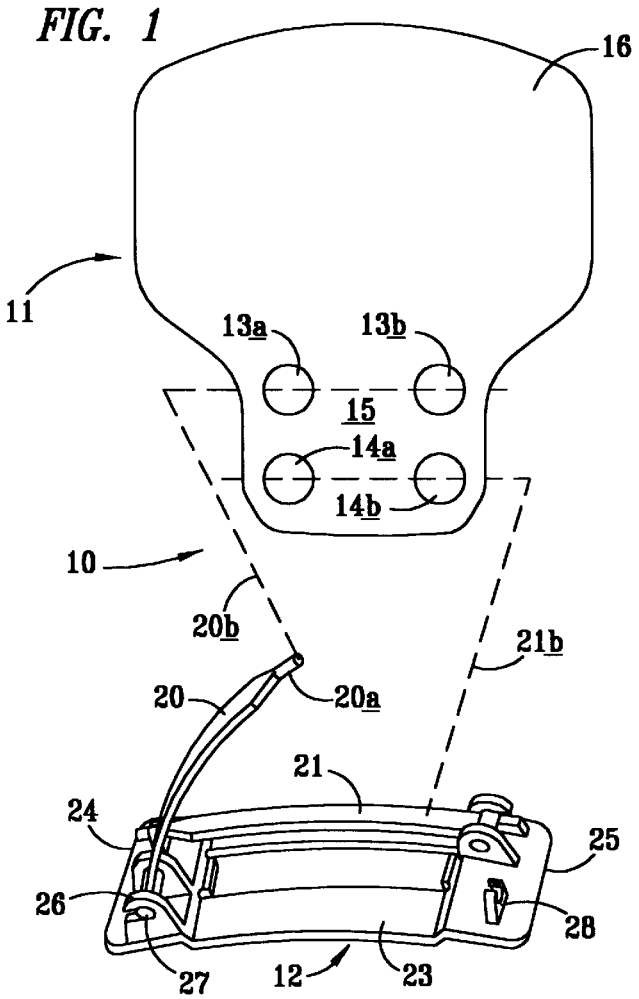
FIG. 1 is a combined front elevation and perspective view of an improved shapeable hair styling accessory and cooperating barrette according to the invention.

Now turning to the FIG. 1 of the drawing, it will be seen that depicted there (in an exploded view) are the preferred embodiment 10 of the combined improved shapable hair styling accessory 11 (the aforementioned poof) and cooperating barrette 12 according to the invention. Also depicted are dashed lines 20*b* and 21*b* which illustrate the passage of fastening fingers 20 and 21 through two sets of apertures 13*a*/13*b* and 14*a*/14*b* positioned within lower appending section 15 of poof 11 when the poof and barrette are assembled together in combination Thus, for example, finger 20 is extended upwardly through aperture 13*a* and longitudinally over and across the region between apertures 13*a* and 13*b* before descending downwardly through aperture 13*b*. Finger, 21, on the other hand is projected upwardly through aperture 14*b* and longitudinally over and across the region between apertures 14*b* and 14*a* before descending downwardly through aperture 14*a*. Also shown are upper main section 16 which, as discussed below, is generally puffed out with convex front and rear surfaces 16*a* and 16*b* (FIG. 3) to present a convex, or puffed, appearance.

Figure 2:
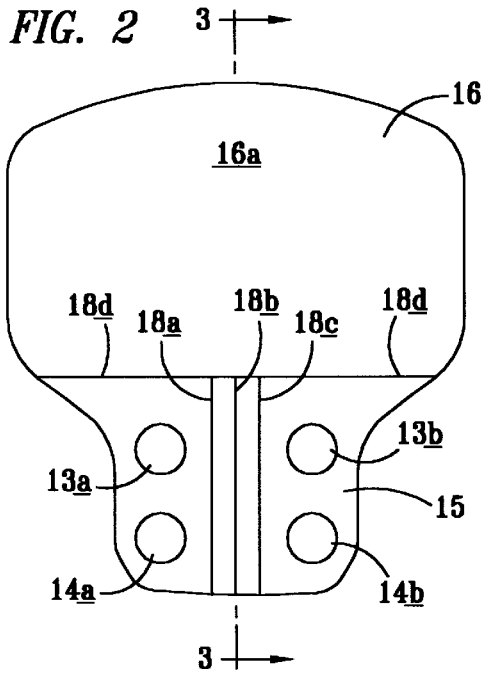
FIG. 2 is a front elevation view of the shapeable hair styling accessory according to the invention.

Now turning to FIG. 2, the poof is seen in greater detail. There are the aforementioned pairs of side-by-side apertures 13*a*/13*b* and 14*a*/14*b* symmetrically disposed as depicted about a center line represented by vertical section lines 3—3. As mentioned above, and as evident from the drawing, the poof is generally disposed in two sections: upper section 16, and a lower appending section 15. Neck region 17 marks the transition the between the sections and is located at the region in which upper section 16 and lower section 15 join each other, as particularly shown in FIGS. 3 and 4.

Surfaces 16*a* and 16*b* are preferably sheaths of conventional resilient material whose exterior surfaces are adapted for clinging to the hair on the user's head and may be any of a variety of such materials conventionally used for resilient hair dressing accessories. Items 18*a*, 18*b*, 18*c* and 18*d* are shown to identify bonding lines which present a pleasing esthetic appearance while defining regions in which the front and rear materials are bonded together.

Figure 3:
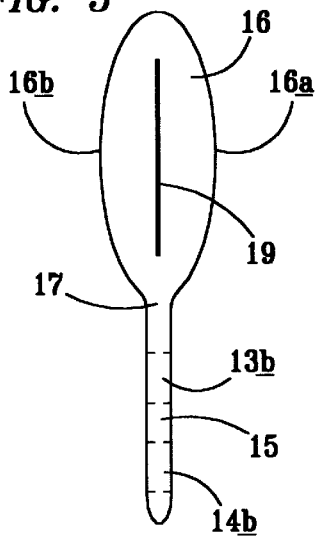
FIG. 3 is a section taken along the section lines 3—3 of FIG. 2.
Figure 4:
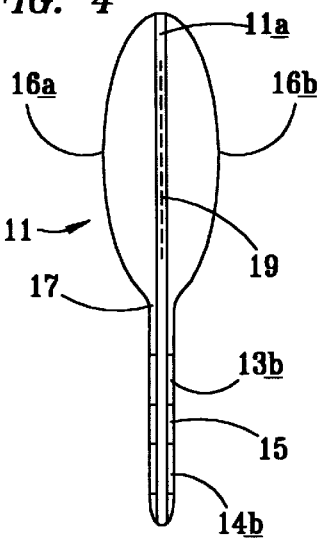
FIG. 4 is a side view of the accessory of FIG. 2.
Figure 5:
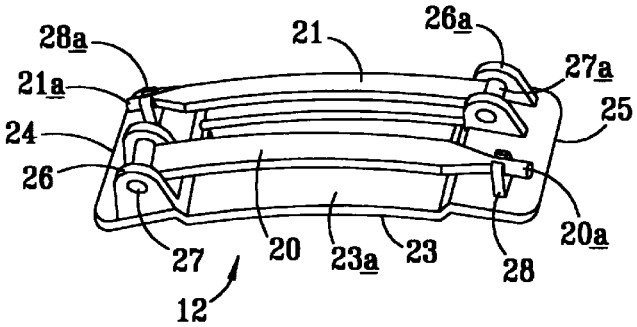
FIG. 5 is a perspective view of an improved barrette according to the invention.
Figure 6:
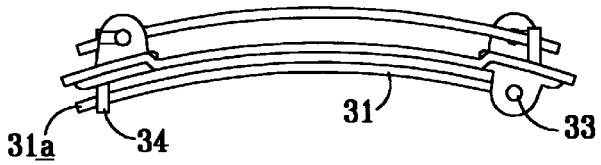
FIG. 6 is a side view of the barrette of FIG. 5.
Figure 7:
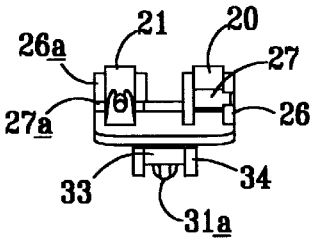
FIG. 7 is an end view of the barrette of FIG. 5.

Further reference to FIG. 3 reveals the presence of the aforementioned interiorly disposed thin sheet 19 of malleable material, preferably tin or aluminum foil sheeting about 0.0006 inches thick such as that used for fin metal in air conditioners. This, as mentioned above, provides a shaping capability for the poof. Thus, the poof may be manually bent and re-bent by the user into desired shapes which the poof will normally retain when in place within one's hair.

As mentioned above, FIG. 4 is a side view of the poof accessory of FIGS. 2 and 3. There will be seen a seam 11*a* which extends about the entire periphery of poof 11. The aforementioned thin sheet of malleable material 19 is also seen to be disposed inside the poof, and the generally convex shape of the exterior surfaces 16*a* and 16*b* is again depicted.

Now turning to FIGS. 5–9, the preferred embodiment of cooperating barrette 12 will be seen. The barrette includes generally rectangular base member 23 having slightly curved, or semi-planar upper and lower surfaces 23*a* and 23*b*, and having at its longitudinal extremities, ends 24 and 25. Mounted on the base are a plurality of clasping assemblies as hereinafter described. Thus, near the left end 24, there is mounted a hinge member 26 which includes swivel pin 27 to which finger 20 is attached, thus permitting finger 20 to swivel about the central axis of pin 27 and to achieve the position depicted in FIG. 1. As will be observed from the Figure, hinge member 26 and finger 20 are disposed parallel to but displaced to one side of the center line (not shown) of the base member 23 as it extends longitudinally from end 24 to end 25.

To complete a first clasping assembly, near the opposite end 25 of base 23, there is mounted a conventional disengageable locking member 28 which is provided for disengageably locking the end 20*a* in place when the barrette is in use.

Further inspection of the Figures reveals the presence of another clasping assembly comprising another swivelable finger assembly parallel to but displaced to the opposite side of the center line of the base member 23 from that of finger 20. This other finger assembly comprises finger 21 with extending end 21*a*, conventional disengageable locking member 28*a* for locking end 21*a* in place when the barrette is in use. This other finger assembly also includes hinge member 26*a* containing swivel pin 27*a* to which finger 21 is attached, thus permitting finger 21 to swivel about the central axis of pin 27*a* in a manner similar to that of finger 20. In addition to the above-described elements of barrette 12, FIGS. 6–9 depict a third finger assembly mounted on the lower side 23*b* of main base member 23. There, it will be seen are finger 31 having an end 31*a*, conventional disengageable locking member 34 for locking end 31*a* in place when the barrette is in use, and hinge member 32 containing swivel pin 33 to which finger 31 is attached, thus permitting finger 31 to swivel about the central axis of pin 33*a* in a manner similar to that described for fingers 20 and 21 above.

Figure 8:
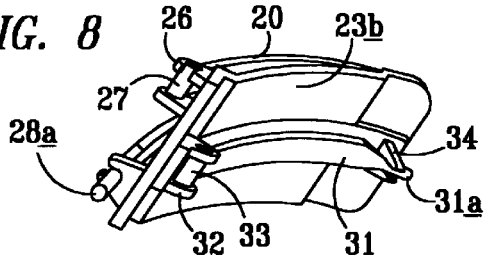
FIG. 8 is a perspective view of the barrette of FIGS. 5–7 particularly illustrating the under side of the barrette.
Figure 9:
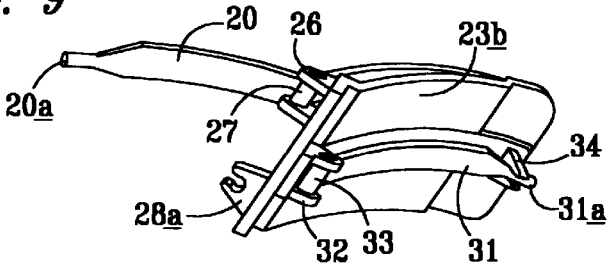
FIG. 9 is another perspective view of the barrette of FIGS. 5–8 showing one of the fastening fingers in an extended condition.

It will now be apparent that the two upper fingers are provided to pass respectively through the two side-by-side sets of apertures, with one finger (e.g., finger 21) passing through apertures 13*a*/13*b* and the other upper finger (e.g., finger 20) passing in the opposite direction through apertures 14*a*/14*b* in the manner described in connection with FIG. 1. The third, or bottom, finger assembly which includes finger 31 shown and described in connection with FIGS. 8 and 9 is employed to engage one or more locks or strands of the users hair to hold the barrette in place either by itself or when the poof is locked thereto as described above.

It will now be evident that there has been described herein an improved hair styling accessory herein referred to as a poof together with a cooperating barrette specially adapted for optional use in locking the poof in place within a hair styling configuration. It will also be evident that it presents a number of advantages.

Although the invention hereof has been described by way of a preferred embodiment, it will be evident that other adapt ations and modifications may be employed without departing from the spirit and scope thereof Thus, for example, additional layers of material could be employed.

The terms and expressions employed herein have been used as terms of description and not of limitation; and thus, there is no intent of excluding equivalents, but on the contrary it is intended to cover any and all equivalents that may be employed without departing from the spirit and scope of the invention.

I claim:

1. A barrette comprising an elongated base member having a first axis defining a center line of an elongated dimension of said elongated base member, said base member having an upper generally planar surface, a lower generally planar surface, a first end and an opposite end at opposite extremities of said base member, a first hinge on said upper surface adjacent said first end and offset to a first side of said axis, a first elongated clasping member having a free end and a first elongated central axis, said first elongated clasping member being pivotably attached to said base member through said first hinge thereby connecting said first elongated clasping member to said base member to position said elongated central axis of said first elongated clasping member parallel to and offset from said first axis, a first disengageable locking member mounted on said upper surface at said opposite end for disengageably locking said free end of said first elongated clasping member when said first elongated clasping member is pivoted to bring said free end of said first elongated clasping member into engagement with said first locking member; a second hinge on said upper surface adjacent said opposite end and offset to an opposite side of said axis from said first side, a second elongated clasping member having a free end and an elongated central axis, said second elongated clasping member being pivotably attached to said base member through said second hinge thereby connecting said second elongated clasping member to said base member to position said elongated central axis of said second elongated clasping member parallel to and offset from said first axis, a second disengageable locking member on said upper surface at said first end for disengageably locking said free end of said second elongated clasping member when said second elongated clasping member is pivoted to bring said free end of said second clasping member into engagement with said second locking member; and a third elongated clasping assembly mounted on said lower generally planar surface.

2. A barrette according to claim 1 wherein said base member is essentially rectangular in geometry.

3. A barrette according to claim 1 wherein said third elongated clasping assembly comprises a third hinge on said lower surface adjacent one of said ends, a third elongated clasping member having a free end and an elongated central axis, said third elongated clasping member being pivotably attached to said base member through said third hinge thereby connecting said third elongated clasping member to said base member to position said elongated central axis of said third elongated clasping member parallel to said first axis, and a third disengageable locking member mounted on said lower surface for disengageably locking said free end of said third elongated clasping member when said third elongated clasping member is pivoted to bring said free end of said third elongated clasping member into engagement with said third locking member.

4. A barrette according to claim 1 wherein said upper and lower generally planar surfaces are substantially parallel to each other.

5. A barrette according to claim 1 wherein said first end and said opposite end are at opposite ends of said first axis and said opposite extremities of said base member.

* * * * *